United States Patent [19]

Tracy

[11] 4,203,718

[45] May 20, 1980

[54] REGISTER

[75] Inventor: James L. Tracy, Rexville, N.Y.

[73] Assignee: Foster Wheeler Energy Corporation, Livingston, N.J.

[21] Appl. No.: 920,520

[22] Filed: Jun. 29, 1978

[51] Int. Cl.[2] ..... F23M 9/00

[52] U.S. Cl. ..... 431/188; 239/407 X

[58] Field of Search ..... 431/188, 187, 182, 183, 431/184; 239/457, 559, 567, 455, 451; 251/340, 347; 137/625.33

[56] References Cited

U.S. PATENT DOCUMENTS

| | | | |
|---|---|---|---|
| 1,025,279 | 5/1912 | Laing | 431/183 |
| 1,157,841 | 10/1915 | Bradshaw | 431/187 |
| 1,449,840 | 3/1923 | Reid | 431/183 |
| 2,869,625 | 1/1959 | Hogberg et al. | 431/184 |
| 2,982,345 | 5/1961 | Draijer | 431/187 |
| 3,463,602 | 8/1969 | Bitterlich et al. | 431/188 |

*Primary Examiner*—Carroll B. Dority, Jr.
*Assistant Examiner*—Randall L. Green
*Attorney, Agent, or Firm*—Marvin A. Naigur; John E. Wilson; John J. Herguth, Jr.

[57] ABSTRACT

A register for regulating the flow of air toward an inner combustion region has a plurality of spaced and inwardly directed vanes affixed between two annular members. A plurality of spaced guide means peripherally disposed around the vanes, are mounted across the two annular members. A sleeve which is linearly movable upon the guide means enshrouds the vanes by a variable amount. By moving the sleeve, the inward flow of air past the vanes can be regulated.

7 Claims, 3 Drawing Figures

REGISTER

BACKGROUND OF THE INVENTION

In many turbine and boiler installations fuel combustion occurs at the outlet of a burner which is encircled by a register. Typically, the burner is mounted at an aperture in a furnace wall and injects fuel through that aperture. The register provides a path for supplying external air to the injected fuel. Air is induced to flow through the register to the burning fuel by either a forced air duct or by a natural chimney draft. The register operates to adjust the volume flow of air in order to establish an air to fuel ratio consistent with high efficiency and complete combustion. For a system having several burners which are supplied by common air ducts it is also important to regulate the airflow to maintain a balance among the burners.

A widely used register employs rotatable vanes which act like louvers. In this arrangement the volume flow of air depends upon the extent to which the vanes are aligned with or tranverse to the flow of air toward the burner. In addition to regulating the volume of airflow, these vanes uniformly surround the burning fuel with an inward airflow which fosters a homogenous mixing of air and fuel. While this register operates satisfactorily it employs many moving parts and associated linkage.

Since a register is a structure which is open in the sense that air must pass through it, a balance between structural rigidity and the free passage of air is a significant consideration. To provide rigidity and proper mixing of air and fuel a register described herein has vanes which are affixed between two annular members. The volume of airflow is regulated by a movable sleeve which travels on guides disposed around the vanes so that the vanes are enshrouded a variable amount. With the sleeve adjusting air flow, the vanes provide structural strength and rigidity. In addition, since relatively few moving parts are required, reliability is enhanced.

SUMMARY OF THE INVENTION

In accordance with an illustrative embodiment demonstrating features and advantages of the present invention, there is provided a register for regulating the flow of air toward an inner combustion region. The register includes a first annular member and a second annular member. The second annular member is spaced alongside the first annular member. Also included is a plurality of spaced vanes affixed between the first and second annular members. The plurality of spaced vanes are inwardly directed. The register also includes a plurality of spaced outer guides mounted across the first and second annular members. The plurality of spaced outer guides are peripherally disposed around the plurality of spaced vanes. Also included is a sleeve encircling and bearing upon the plurality of spaced outer guides. The sleeve is linearly movable to enshroud the vanes a variable amount. Thus the flow of air past the plurality of spaced vanes is regulated by moving the sleeve.

BRIEF DESCRIPTION OF THE DRAWINGS

The above brief description as well as further objects features and advantages of the present invention will be more fully appreciated by reference to the following detailed description of a presently preferred but nonetheless illustrative embodiment in accordance with the present invention when taken in connection with the accompanying drawings wherein.

DETAILED DESCRIPTION OF THE PREFERRED EMBODIMENT

Figure 1:
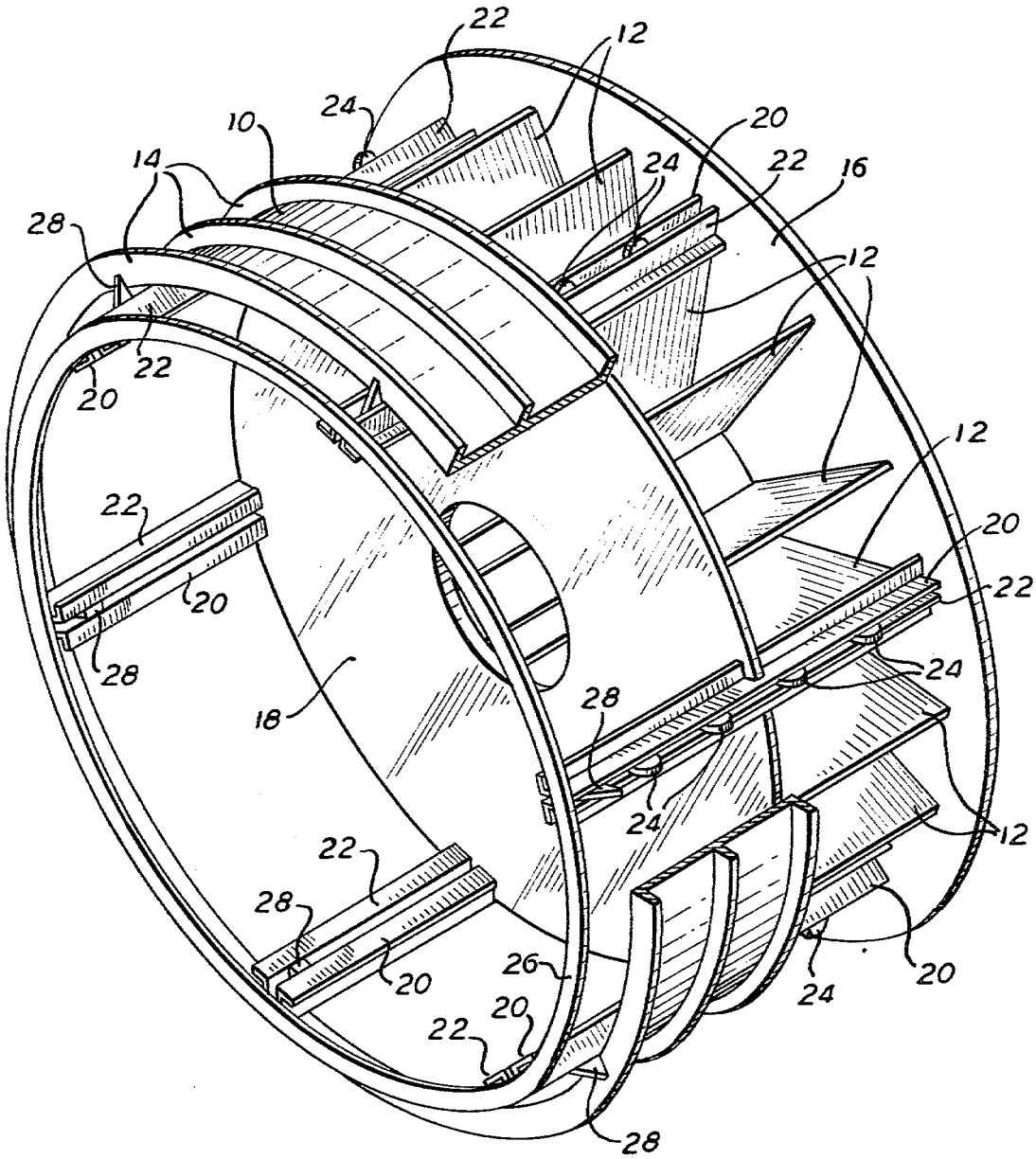
FIG. 1 is a perspective view of a register of the instant invention in which part of its sleeve is broken away to more clearly show the outer guides.

Referring to FIG. 1, a register in accordance with the present invention is shown having a sleeve 10 retracted away from a plurality of vanes 12. Sleeve 10 is shown as a cylindrical band with circumferential ribs 14, however, it is apparent that in other embodiments it may be shaped otherwise. For example, instead of cylindrical band 10, a band having a polygonal crossection or a funneled shape may be employed. Vanes 12 are shown as eighteen rectangular plates, although other arrangements employing curved fins may be constructed. Vanes 12 are welded between first annular member 16 and a second annular member 18, both members shown herein as parallel circular plates with concentric circular apertures. Plate 16 has a larger inside and outside diameter than plate 18. Plates 16 and 18 are centered on a common orthogonal axis. While the vanes 12 are shown herein lying in planes radiating from that common orthogonal axis, they may be skewed from that orientation in other embodiments. The interspaces between vanes 12 define inwardly directed airways. Since the vanes 12 do not converge into each other, an axial passageway through the apertures of plates 16 and 18 is provided in which a burner (not shown) may be installed. Such a burner transports fuel through plate 18 toward plate 16.

A plurality of symetrically spaced outer guide means are shown herein as complimentary pairs of elongated brackets 20, 22 which are parallel and have four evenly spaced guide wheels 24 journaled between them. Each of the wheels 24 extend outwardly beyond the angle irons 20, 22. Sleeve 10 is sized to contact and freely roll upon wheels 24. Each bracket 20, 22 has one of its ends welded to plate 16 and its other end welded to ring 26. Brackets 20, 22 are also welded into slots located every 60° along the circumference of plate 18. The brackets 20, 22 are positioned in radial alignment with every third vane of the vanes 12, although such alignment is not necessary. It is apparent that instead of wheels 24 and brackets 20, 22, other apparatus may be employed. For example, a lubricated groove which receives an inner guide rib projecting from a sleeve, will operate satisfactorily.

Located near ring 26 are stops 28 which are welded, one apiece, between each pair of angle irons 20, 22. Stops 28 limit the extent to which sleeve 10 can retract from vanes 12 and also prevent sleeve 10 from becoming separated from the register. Sleeve 10 may move into abutment with plate 16 to fully enshroud and close off the airways of vanes 12. Of course, sleeve 10 can be positioned anywhere between its two extreme positions so that the airways between vanes 12 can be continuously throttled.

It should be observed that plates 16 and 18 are rigidly attached to one another by thirty structural members: the eighteen vanes 12 and the twelve angle irons 20, 22. Notwithstanding the many structural members between plates 16 and 18, air may freely pass between vanes 12, provided sleeve 10 is in the fully retracted position as shown.

Figure 2:
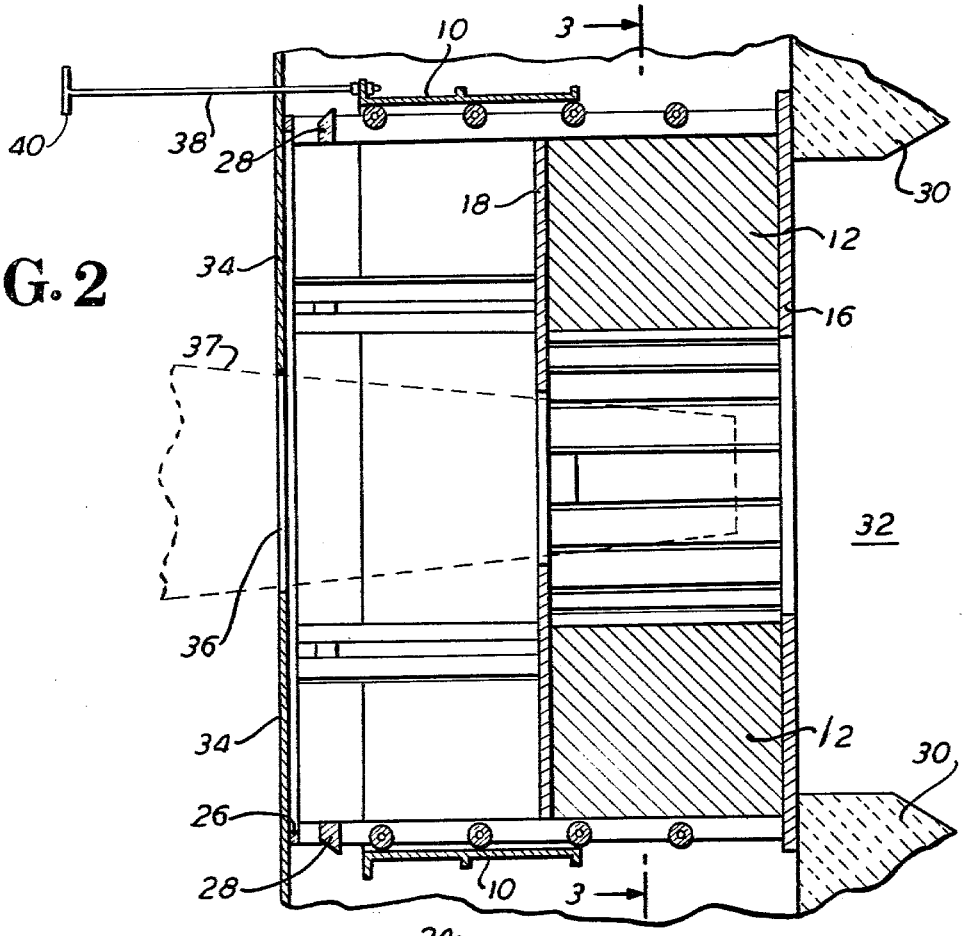
FIG. 2 is a vertical sectional view of the register of FIG. 1, shown mounted onto a furnace wall.

Referring to FIG. 2 the previously described register is shown fastened to a furnace wall 30. The interior of the furnace is a combustion region generally designated region 32. Encasing the register is duct wall 34. The space between walls 34 and 30 defines an air passageway or duct through which air may flow past vanes 12 and into combustion region 32.

A burner may be installed by inserting it through the aperture of plate 18 and suitably fastening it thereto. The outline of the forward end of such burner 37 is shown in phantom. When so installed, effectively no air passes through the aperture 36 of duct wall 34 or the aperture of plate 18. Accordingly, the primary flow of air is past vanes 12, through the aperture of plate 16 and into combustion region 32.

Sleeve 10 is shown displaced from stops 28 so that vanes 12 are partially enshrouded. The position of sleeve 10 is manually adjustable by means of elongate member 38 which is bolted to sleeve 10. Member 38 extends through a hole in wall 34 and terminates in a handle 40. Thrusting handle 40 toward furnace wall 30 closes the airway to combustion region 32 while pulling the handle away opens the airway.

Figure 3:
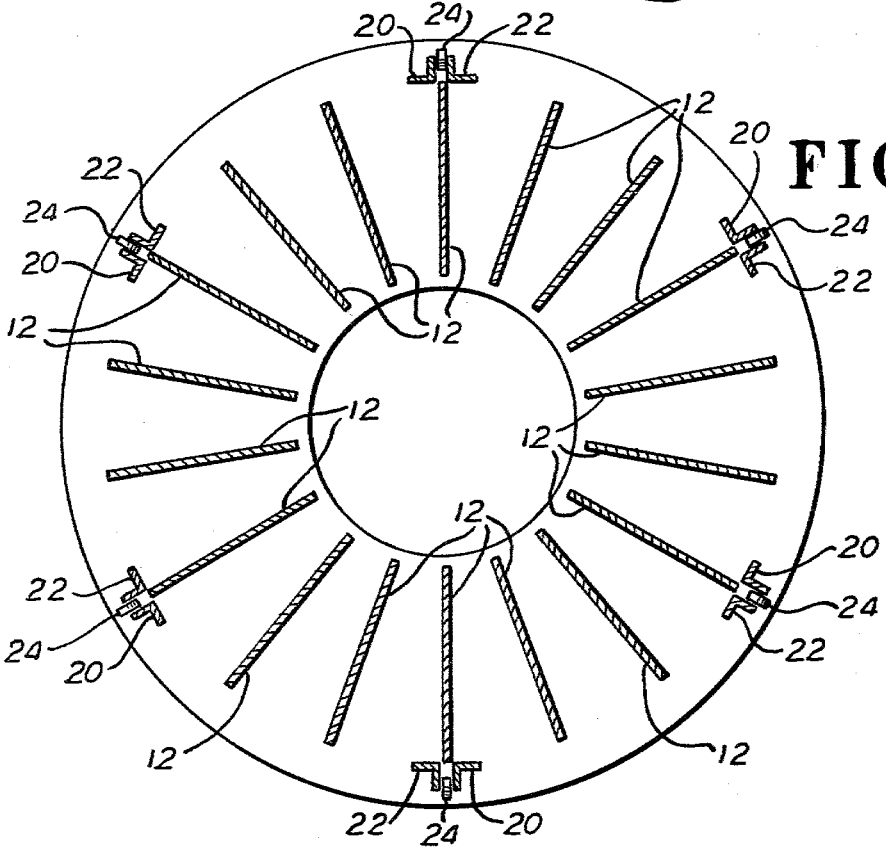
FIG. 3 is a sectional view taken along line 3—3 of FIG. 2.

Referring to FIG. 3, a sectional view along lines 3—3 of FIG. 2 more clearly shows the angular relation among vanes 12. In this view vanes 12 are seen to radially project from the center of plate 16. There being eighteen equiangular members of vanes 12, adjacent members are displaced 20° apart, although a different number and spacing may be employed. This relatively close interspacing provides a narrow airway which produces a relatively laminar and radially directed airflow. Establishing a well-controlled airflow in this manner allows homogenous mixing of air and fuel. Brackets 20 and 22 and wheels 24 are shown in radial alignment with every third one of vanes 12. Accordingly a set of wheels 12 and brackets 20 and 22 are peripherally disposed around vanes 12 at 60° intervals. It is apparent that wheels 24 and brackets 20 and 22 may be spaced differently in other embodiments. Since wheels 24 outwardly project beyond brackets 20 and 22 and beyond vanes 12, sleeve 10 (previously illustrated) is borne by wheels 24.

From the foregoing, it can be appreciated that in accordance with the present invention there has been provided a register having a plurality of vanes 12 affixed between first annular member 16 and a second annular member 18. This relatively rigid structure is enshrouded by a sleeve 10 which is linearly movable to adjustably throttle the airways between vanes 12. This throttling may be accomplished with relatively few moving parts.

It is apparent that the shapes and outlines described herein may be modified to suit the size and capacity of a specific furnace and burner. Moreover, while the components are shown herein as axially symetric, other embodiments may be asymetric. Also it is expected that various materials including metals will operate satisfactorily and that their thicknessess and dimensions may be chosen to satisfy the required strength, weight, etc.

A latitude of modification, change and substitution is intended in the foregoing disclosure and in some instances some features of the invention will be employed without a corresponding use of other features. Accordingly it is appropriate that the appended claims be construed broadly and in a manner constituent with the spirit and scope of the invention herein.

What is claimed is:

1. A register for regulating the flow of air toward an inner combustion region comprising:

a first annular member;

a second annular member spaced alongside said first annular member;

a plurality of spaced vanes affixed between said first and second annular members, said plurality of spaced vanes being inwardly directed;

a plurality of spaced outer guide means mounted across said first and second annular members, said plurality of spaced outer guide means being peripherally disposed around said plurality of spaced vanes; and a sleeve encircling and bearing upon said plurality of spaced outer guide means, said sleeve being linearly movable to enshroud said vanes a variable amount, whereby the flow of air past said plurality of spaced vanes is regulated by moving said sleeve.

2. A register according to claim 1 wherein said first and second annular members are rigidly attached to said plurality of spaced outer guide means and to said plurality of spaced vanes whereby the structural rigidity of said register is enhanced by said plurality of spaced vanes and by said plurality of spaced outer guide means.

3. A register according to claim 2 wherein said first and second annular members comprise parallel circular plates each having a concentric circular aperture centered on a single orthogonal axis, each one of said plurality of spaced vanes being disposed in a plane radiating from said single orthogonal axis.

4. A register according to claim 3 wherein said sleeve comprises a cylindrical band movable from an open to a closed position, in said closed position said cylindrical band fully encompassing said plurality of spaced vanes, in said open position said cylindrical band being disposed alongside said plurality of spaced vanes.

5. A register according to claim 4 wherein each one of said plurality of spaced outer guide means comprises:

an elongated bracket affixed to said first and to said second annular members, said elongated bracket extending past said second annular member in a direction away from said first annular member and parallel to said single orthogonal axis; and a plurality of spaced guide wheels rotatably mounted upon said bracket.

6. A register according to claim 5 further comprising:

a ring attached to one end of each of said plurality of spaced outer guides, the other end of each being attached to said first annular member.

7. A register according to claim 6 further comprising:

an elongate member attached to said sleeve for manually and remotely adjusting its position.

* * * * *